US005336342A

United States Patent [19]

Ashok

[11] Patent Number: 5,336,342

[45] Date of Patent: Aug. 9, 1994

[54] COPPER-IRON-ZIRCONIUM ALLOY HAVING IMPROVED PROPERTIES AND A METHOD OF MANUFACTURE THEREOF

[75] Inventor: Sankaranarayanan Ashok, Bethany, Conn.

[73] Assignee: Olin Corporation, New Haven, Conn.

[21] Appl. No.: 606,382

[22] Filed: Oct. 31, 1990

Related U.S. Application Data

[63] Continuation-in-part of Ser. No. 385,034, Jul. 26, 1989, Pat. No. 5,017,250.

[51] Int. Cl.[5] ..... C22C 9/00

[52] U.S. Cl. ..... 148/432; 420/492; 420/496

[58] Field of Search ..... 420/492, 496; 148/411–414, 432–436; 428/614

[56] References Cited

U.S. PATENT DOCUMENTS

| | | | |
|---|---|---|---|
| Re. 31,767 | 12/1984 | Brooks | 29/527.2 |
| 3,615,899 | 10/1971 | Yokahama et al. | 148/11.5 |
| 3,635,701 | 1/1972 | Davies et al. | 75/135 |
| 4,135,924 | 1/1979 | Tanner et al. | 420/492 |
| 4,398,969 | 8/1983 | Melton et al. | 148/11.5 |
| 4,406,858 | 9/1983 | Woodford et al. | 420/492 |
| 4,434,016 | 2/1984 | Saleh et al. | 148/12.7 |
| 4,436,560 | 3/1984 | Fujita et al. | 148/6 |
| 4,540,546 | 9/1985 | Giessen | 420/590 |
| 4,585,494 | 4/1986 | Ashok et al. | 148/435 |
| 4,605,532 | 8/1986 | Knorr et al. | 420/472 |
| 4,732,731 | 3/1988 | Asai et al. | 420/473 |
| 4,737,340 | 4/1988 | Dolgin | 420/129 |
| 4,744,947 | 5/1988 | Nilmen et al. | 420/590 |
| 4,792,365 | 12/1988 | Matsui et al. | 148/12.7 |
| 4,804,034 | 2/1989 | Leatham et al. | 164/46 |
| 4,818,283 | 4/1989 | Grunthaler et al. | 75/247 |

FOREIGN PATENT DOCUMENTS

| | | | |
|---|---|---|---|
| 53-34623 | 3/1978 | Japan | 420/492 |
| 61-183425 | 2/1985 | Japan . | |
| 62-192548 | 1/1986 | Japan . | |
| 62-199743 | 2/1986 | Japan . | |
| 62-247040 | 4/1986 | Japan . | |
| 63-143230 | 12/1986 | Japan . | |
| 2172900A | 10/1986 | United Kingdom . | |
| 89/05870 | 6/1989 | World Int. Prop. O. . | |

OTHER PUBLICATIONS

"Rapid Quenching of Eutectic Copper Melts", Savitskii et al, Prakt. Metallogr. 17(9), 429–39, 1980.

"Evolution of Microstructure in Spray Cast Cu–Zr", Singh et al, Modern Devels. in Powder Metalgy.(-Conf.), vol. 19, Jun. 1988.

"Metastable States of Binary Copper Alloys Produced by Super–Rapid Quenching of the Melt", J. of the Less Common Metals, 97(1984), pp. 271–275.

"Mechanical Properties of Multiphase Alloys", Ch. 22, Physical Metallurgy, Part II, 1983, pp. 1415–1417.

"Metallography, Structures and Phase Diagrams", Metals Handbook, 8th Ed., V. 8 pp. 293–302, 1973.

"Evolution of Microstructure in Spray Cast Cu–Zr", by Singh et al, Drexel Un., pp. 489–502, 1988.

*Primary Examiner*—George Wyszomierski

*Attorney, Agent, or Firm*—Gregory S. Rosenblatt; Bruce E. Burdick

[57] ABSTRACT

A copper based alloy and method for the manufacture thereof having improved properties. The copper alloy contains iron and zirconium with the iron being present as a uniformly dispersed second phase of the dispersoids. The dispersoids have a mean particle size of from about 0.1 micron to about 1.0 micron. The iron is present in the amount of from about 0.25 to about 5.0% by weight.

2 Claims, 2 Drawing Sheets

COPPER-IRON-ZIRCONIUM ALLOY HAVING IMPROVED PROPERTIES AND A METHOD OF MANUFACTURE THEREOF

CROSS-REFERENCE TO RELATED APPLICATION

This application is a continuation-in-part of co-pending U.S. patent application Ser. No. 385,034, entitled "COPPER ALLOYS HAVING IMPROVED SOFTENING RESISTANCE AND A METHOD OF MANUFACTURE THEREOF" by Sankaranarayanan Ashok, filed Jul. 26, 1989, now U.S. Pat. No. 5,017,250.

BACKGROUND OF THE INVENTION

1. Field of the Invention

The present invention relates to an improved copper alloy having improved properties and the method of manufacture thereof. More particularly, the invention relates to a spray cast copper-iron-zirconium alloy having improved mechanical properties.

2. Background Information

Copper based alloys are widely used for electronic, electrical, and thermal applications. Electrical connectors and leadframes are usually formed from copper alloys to exploit the high electrical conductivity inherent in the alloys. Heat sinks, heat exchanger coils, and cooling fins are also manufactured from copper based alloys to take advantage of the excellent thermal conductivity of the alloys.

The copper based alloys are often cold worked following casting to increase the strength of the alloy. When exposed to elevated temperatures, the alloys recrystallize. Recrystallization is accompanied by a loss of structural strength. This phenomenon is often expressed in terms of softening resistance. Softening resistance is a measure of the ability of an alloy to resist deformation when exposed to elevated temperatures. It is desirable to fashion a copper based alloy having high thermal conductivity and high electrical conductivity which also resists softening at elevated temperatures.

The softening of the alloy is a consequence recrystallization. Introducing a means to inhibit recrystallization is a means to improve sottening resistance.

As disclosed in Chapter 22 entitled "Mechanical Properties of Multiphase Alloys" of *Physical Metallurgy* by R. W. Cahn et la, a way to inhibit recrystallization is to supply the alloy with a uniform dispersion of dispersoids. These dispersoids should have a mean size of less than about 1 micron. Larger sized dispersoids deform the crystal grains and introduce intense stress ingredients and can reduce the recrystallization temperature.

Several means to inhibit recrystallization are known. For example, the addition of specific alloying elements to the base alloy. The alloying elements precipitate upon exposure to heat and form a second phase. This process is known as precipitation hardening. The second phase is small, typically on the order of nanometers, and forms throughout the alloy. An example of a copper based precipitation hardenable alloy is copper alloy C724 which has a composition of from about 10% to about 15% by weight nickel, from about 1% to about 3% by weight aluminum, up to about 1% by weight manganese, from about 0.05% to less than about 0.5% by weight magnesium, less than about 0.05% by weight silicon and the balance copper. Copper alloy C724 is disclosed in U.S. Pat. No. 4,434,016 to Saleh et al.

Another means to inhibit recrystallization is known as dispersion hardening. For example, by internally oxidizing the alloy so that oxide particles are dispersed through the alloy. Internal oxidation of a copper based alloy has been disclosed in U.S. Pat. No. 3,615,899 to Kimura et al.

Both precipitation hardening and dispersion hardening involve altering the internal structure of the alloy subsequent to solidification. The processes require additional thermal treatments adding to the cost of the alloy. Further, these prior art processes are self-limiting as to the quantity and size of the second phase particulate as well as to the composition of the alloy.

Yet another way to form a second phase within a copper based alloy is through solidification. The second phase may form either at the beginning of solidification, for example a peritectic type reaction or at the end of solidification, for example a eutectic type reaction.

During a conventional casting process such as direct chill casting, the solidification rate is relatively slow. Second phase dispersoids are formed during solidification. The dispersoids increase in size and coarsen during the relatively long time period for solidification. The coarse dispersoids can be deformed and elongated or breakup during cold rolling to form stringers. Stringers adversely affect the properties of the alloy by introducing directionally to the ductility and bend properties. Furthermore, the size and distribution of the second phase precludes grain boundary pinning required to prevent recrystallization.

If the solidification rate of the cast alloy is increased, control over the second phase development is improved. One means to increase the solidification rate is through rapid solidification. Rapid solidification involves depositing a molten stream of metal on a chilled collector surface. To maintain the high chill rate, the alloy is cast as a thin ribbon. The ribbon is not suitable for leadframe or connector applications where cross-sectional thicknesses in the range of from about 5 mils to about 20 mils are required.

SUMMARY OF THE INVENTION

According to the present invention, a copper-iron-zirconium alloy is spray cast by atomizing molten stream of the alloy to form droplets, cooling the droplets at an effective rate such that the iron forms second phase dispersoid, the rate of cooling being that the dispersoids have a mean size of from about 0.1 micron to about 1.0 micron. The droplets are deposited on a collecting surface and the solidification of the droplets is completed at a rate sufficient to maintain the mean dispersoid size. The iron is present in the amount of from about 2.0 to about 5.0% by weight The copper alloy according to the present invention contains iron and zirconium, with the iron being present as a uniformly dispersed second phase of dispersoids. The dispersoids have a mean particle size of about 0.1 micron to about 1.0 micron. The iron is present in the amount of from about 2.0 to about 5.0% by weight.

The above stated objects, features and advantages as well as others will become apparent to those skilled in the art from the specification and accompanying figures which follow.

DETAILED DESCRIPTION

Figure 1:
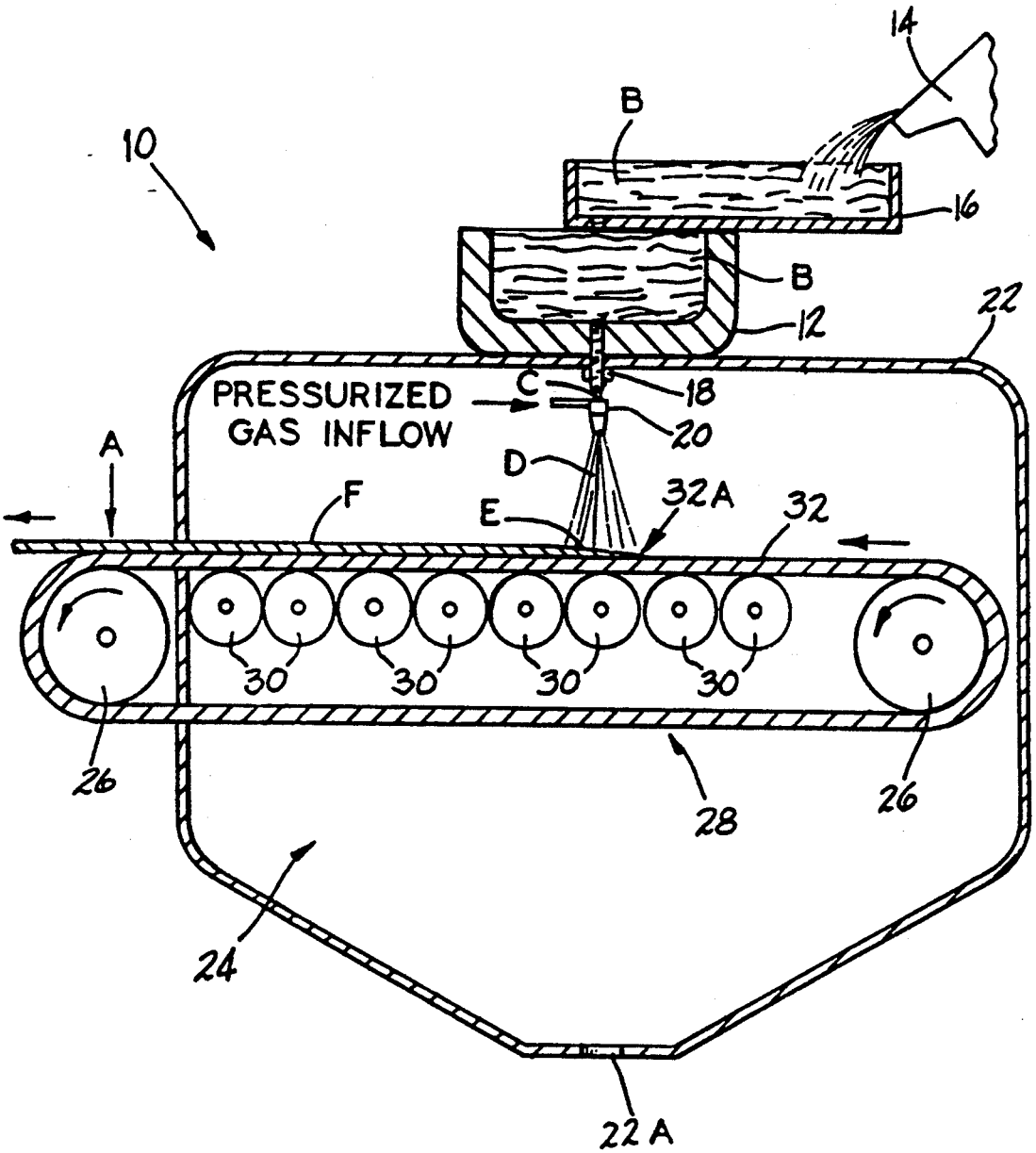
FIG. 1 illustrates a spray deposition apparatus for use in accordance with the process of the invention to manufacture the alloys of the invention.

FIG. 1 illustrates a spray deposition apparatus 10 of the type disclosed in U.S. Pat. Nos. Re. 31,767 and 4,804,034 as well as United Kingdom Patent No. 2,172,900 A all assigned to Osprey Metals Limited of Neath, Wales. The system as illustrated produces a continuous strip of product A. The manufacture of discrete articles is also possible.

The spray deposition apparatus 10 employs a tundish 12 in which a metal alloy having a desired composition B is held in molten form. The tundish 12 receives the molten alloy B from a tiltable melt furnace 14 via a transfer lauder 16. The tundish 12 further has a bottom nozzle 18 through which the molten alloy B issues in a continuous stream C. A gas atomizer 20 is positioned below the tundish bottom nozzle 18 within a spray chamber 22 of the apparatus 10.

The atomizer 20 is supplied with a gas under pressure from any suitable source. The gas serves to atomize the molten metal alloy and also supplies a protective atmosphere to prevent oxidation of the atomized droplets. The gas should preferably not react with the molten alloy. A most preferred gas is nitrogen. The nitrogen should have a low concentration of oxygen to avoid the formation of oxides. The oxygen concentration is maintained below about 100 ppm and most preferably below about 10 ppm.

The atomization gas is impinged against the molten alloy stream under pressure producing droplets having a mean particle size within a desired range. While the gas pressure required will vary (from about 30 psi to about 150 psi) dependent on the diameters of the molten stream and the atomizing orifices, a gas to metal ratio of from about 0.24 $m^3/kg$ to about 1.0 $m^3/kg$ has been found to produce droplets having a mean diameter of up to about 500 microns. This size range cools at a desired rate to produce copper based alloys with the desired properties as discussed below. More preferably, the mean particle size is from about 50 to about 250 microns.

The atomizer 20 surrounds the molten metal stream C and impinges the gas on the stream C converting the stream into a spray D comprising a plurality of atomized molten droplets. The droplets are broadcast downward from the atomizer 20 in the form of a divergent conical pattern. If desired, more than one atomizer 20 may be used. The atomizer(s) 20 may be moved in a desired pattern for a more uniform distribution of molten metal particles.

A continuous substrate system 24 as employed by the apparatus 10 extends into the spray chamber 22 in generally horizontal fashion and in spaced relation to the gas atomizer 20. The substrate system 24 includes a drive means comprising a pair of spaced rolls 26, an endless belt 28 and a series of rollers 30 which underlie and support an upper run 32 of the endless substrate 28. An area 32A of the substrate upper run 32 directly underlies the divergent pattern of spray D. The area 32A receives a deposit E of the atomized metal particles to form the metal strip product A.

The atomizing gas flowing from the atomizer 20 is much cooler than the molten metal B in the stream C. Thus, the impingement of atomizing gas on the spray particles during flight and the subsequent deposition on the substrate 28 extracts heat from the particles. The metal deposit E is cooled to below the solidus temperature of the alloy B forming a solid strip F which is carried from the spray chamber 22 by the substrate 28.

The droplets striking the collecting surface 28, are preferably in a partially solidified state so that solidification is enacted upon impact with the collector. The collector is positioned at a desired distance below the atomization point at a point where most droplets are partially molten. The droplets are preferably at or near the solidification temperature upon impact.

By controlling the temperature of the molten alloy, the gas volume to metal ratio, the gas flow rate, the temperature of the gas, the collector surface temperature and the distance between the atomizer and the collector surface, the cooling rate of the droplets may be accurately controlled. When the cooling rate is at an effective rate as discussed hereinbelow, the second phase has a mean particle size of from about 0.1 micron to about 1.0 micron. To inhibit recrystallization, a mean second phase particle size of from about 0.1 micron to about 0.5 micron is believed to be preferred.

The cooling rate of the droplets is selected to be effective to control the growth of the second phase during solidification. For copper based alloys, a cooling rate of greater than about 1° C./second is satisfactory. More preferably, the cooling rate is from about 10° C./second to about 100° C./second.

The cast alloy is formed from a vast multitude of individual droplets having a mean particle size of from about 50 microns to about 250 microns. Each droplet contains a plurality of second phase dispersoids, either formed from the liquid during the initiation of solidification (peritectic decomposition) or during the later part of solidification (eutectic decomposition). The cast strip has a thickness many orders of magnitude greater than the individual droplets. The droplets coalesce to form a coherent strip which comprises a metal matrix having a composition approximately the same as the molten stream and a uniformly dispersed second phase. Because the droplets solidify rapidly, within a few seconds after striking the collector surface, the second phase does not significantly increase in size and the coarse precipitate of conventional casting is avoided.

The parameters required to cool the droplets at an effective rate may be readily determined by experimentation. The parameters are dependent on the specific thermal properties of the alloy selected. For most copper base alloys, the following will form a second phase dispersoid having the desired size and distribution:

a. Melt temperature=1200° C.
b. Gas pressure=40 to 140 psi.
c. Collector surface=copper foil over a ceramic material such as PYREX or PYROTEC, the initial temperature of the collector surface is room temperature.
d. Distance between atomizer and collector=6 to 24 inches.

Figure 2:
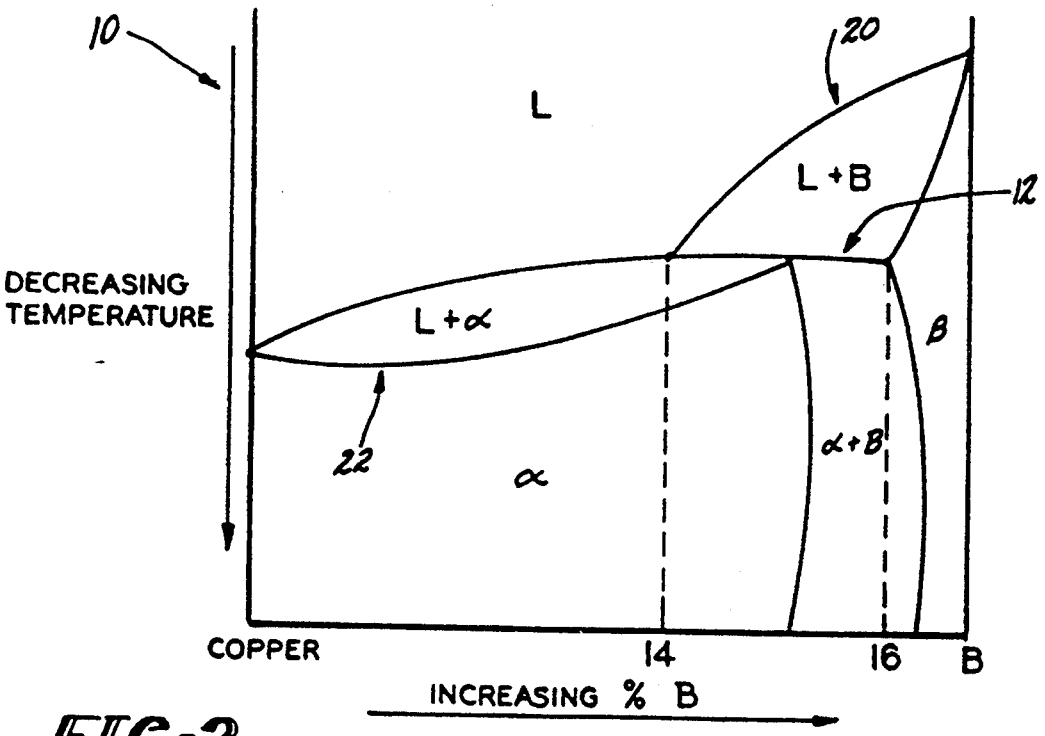
FIG. 2 is a simplified phase diagram of a copper alloy which undergoes peritactic decomposition.

FIG. 2 shows a phase diagram 40 which will be recognized by those skilled in the art as a binary alloy with peritectic solidification. One component of the binary alloy system is copper while the second component may be any alloy which when cast with copper in the proper proportion undergoes peritactic solidification. The peritactic line 42 defines the alloy compositions which undergo a peritactic reaction and is bordered by a maximum copper concentration 44 and a minimum copper concentration 46. The values of the maximum and minimum copper concentrations as well as the peritectic temperature may be obtained from any standard compendum of phase diagrams, for example, pages 293–302 of *Metals Handbook, Eighth Edition* contains phase diagrams for binary copper base alloy systems.

By spray casting alloys having a specific composition, a second phase dispersoid with the desired properties may be generated. The effective concentration range is focused around the point 44 which represents the maximum copper concentration from which the B rich second phase will precipitate. The point 44 is also known as the solid solubility point. The concentration of the B component from about 100% above the B concentration at point 44 to about 20% below the concentration at the point 44. More preferably, the B concentration is from about 25% above the concentration identified by the point 44 to about 10% below this concentration.

While the minimum concentration required to precipitate the B rich phase is usually thought of as the concentration of B at point 44, such an assumption assumes equilibrium solidification. Due to the rapid cooling rate of spray casting and the finite rate of diffusion, the $\beta$ phase precipitate forms at B component concentrations down to about 20% below the concentration identified by the point 44.

A binary alloy containing copper and a second component B which may be a single element or a plurality of alloying elements is supplied to the atomizer in the molten state. The temperature of the molten alloy should be significantly above the liquidus line 50. The second phase begin to precipitate at the liquidus line 50. For most copper base alloys, about 1200° C. is sufficiently above the liquidus temperature. The atomized droplets cool very quickly. The $\beta$ phase is rich in the B component of the alloy and somewhat lower in copper than the bulk alloy. In the region between the peritectic line 42 and the solidus 52, the liquid reacts with the B phase to form the copper rich $\alpha$ phase. However, since the cooling rate is rapid, decomposition back to $\alpha$ is incomplete and $\beta$ phase dispersoids having a size of between about 0.1 microns and 1.0 microns are frozen in the alloy.

The bulk alloy contains a uniform dispersion of the $\beta$ phase dispersoids throughout the alloy. Once the alloy is cooled below the solidus line 52, no further transformation occurs and the $\beta$ phase remains dispersed through the alloy. The spray cast alloy is then cold worked, as by rolling. Cold working introduces dislocations within the crystalline grains and at the grain boundaries. The dislocations resist deformation thereby increasing the strength of the alloy.

When a cold worked alloy is heated, it tends to recrystallize. During recrystallization, the cold worked structure is replaced by a strain free structure and many of the dislocations are annihilated. As a consequence, the alloy softens and the ability to resist deformation is reduced.

However, using the process of the invention, the $\beta$ phase dispersoids inhibit recrystallization. A higher temperature is required to achieve a strain free structure and consequently the alloy resists deformation to a higher temperature.

The advantages of the present invention will become more clear from the following example which is intended to be exemplary and not intended to limit the alloy selection or operating parameters.

EXAMPLE 1

Five samples of copper alloy C194 (having a composition of from about 2.1% to about 2.6% by weight iron, up to about 0.4% by weight phosphorous, from about 0.05% by weight to about 0.15% by weight zinc and the balance copper) were cast. Four samples were prepared by spray casting with variations made to the atomization gas and to the concentration of the iron. The fifth sample was cast by conventional direct chill (D.C.) casting. Table 1 illustrates the starting parameters for each of the five C194 alloys cast.

TABLE 1

| Alloy | Casting Means | Iron Composition | Atomization Gas |
|---|---|---|---|
| A | Spray | 2.45% | 96% $N_2$/4% $H_2$ |
| B | Spray | 2.45% | 96% $N_2$/4% $H_2$ |
| C | Spray | 2.45% | 100% $N_2$ |
| D | Spray | 2.2% | 100% $N_2$ |
| E | D.C. | 2.45% | not applicable |

With reference to FIG. 2, the maximum iron concentration at the solid solubility point 44 is 1.8% for the copper-iron binary alloy and 1.93% by weight iron for the copper-iron-phosphorous-zinc quaternary alloy system. In accordance with the invention, the iron concentration was between about 2.63% by weight ($1.93\%+0.5\times1.93\%$) and about 1.54% by weight ($1.93\%-0.2\times1.93\%$).

After casting, the samples were heated to 500° C. for two hours to precipitate solutionized iron. The castings were then cold rolled to a reduction of 88% to introduce work hardening. The samples were then heated to a temperature of either 300° C., 400° C. or 500° C. The loss in hardness due to thermally induced recrystallization was then measured.

Hardness ($H_v$) was measured using a conventional Vickers Hardness test comprising measuring the depth of penetration of a diamond tipped penetrator and converting the depth into a hardness number.

Table 2 shows the improved softening resistance of the spray cast copper alloys of the invention. Note that R.T. stands for "room temperature" and represents the hardness of the spray cast alloy after cold rolling but before any subsequent heat treatment.

TABLE 2

| | Hardness ($H_v$) after 1 hour at: | | | |
|---|---|---|---|---|
| Alloy | R.T. | 300° | 400° | 500° |
| A | 161 | 157 | 153 | 148 |
| B | 147 | 149 | 143 | 144 |
| C | 145 | 148 | 139 | 136 |
| D | 141 | 139 | 137 | 136 |
| E | 140 | 134 | 122 | 90 |

The softening resistance of the spray cast C194 is superior to the softening resistance of the conventionally cast alloy. Even at temperatures as low as 300° C., the inhibition of recrystallization achieved by the invention resulted in increased deformation resistance. As the temperature was increased, the improvement became more pronounced.

The gas composition did not affect the properties of the spray cast alloy. The benefits of the invention are achieved as long as the gas does not react significantly with the molten droplets. Both pure nitrogen and forming gas (96% nitrogen/4% hydrogen) produced alloys with improved softening resistance.

Also, varying the concentration of the alloying elements had a limited effect within the range of the invention, approximately +50% by weight to about −20% by weight as disclosed hereinabove. Alloys containing 2.45% by weight iron and 2.25% by weight iron both exhibited improved softening resistance.

The invention is not limited to copper based alloys which undergo peritectic transformations. Any alloy system which forms a precipitated second phase during solidification may be improved by the process of the invention.

Figure 3:
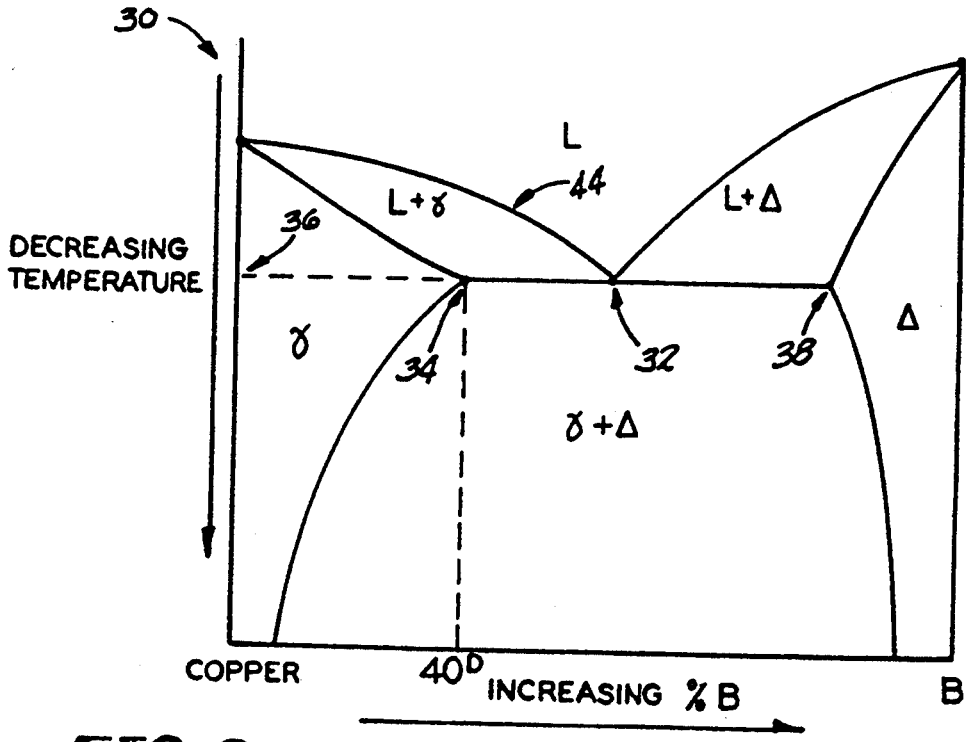
FIG. 3 is a simplified phase diagram of a copper alloy which includes a eutectic phase.

FIG. 3 illustrates a phase diagram 60 for a binary copper alloy including a eutectic phase. The binary alloys which contain copper and include a eutectic phase may be determined from any standard compendum of alloy phase diagrams. The phase diagram 60 identifies the eutectic point 62 and the solid solubility limit point 64. For an alloy having the composition defined by the eutectic point 62, the liquid "L" transforms directly into a dual phase solid containing $\delta$ and $\Delta$ at the eutectic temperature 66. Compositions residing between the solid solubility points 64, 68 will transform from a mixture of a liquid phase and a solid phase to the dual phase solid at the eutectic temperature 66. The solid solubility point 64 defines a composition 10 with the maximum concentration of copper the alloy system may contain and undergo eutectic transformation.

Increasing the concentration of the B component by up to about 50% from the concentration at the solid solubility point 64 as well as reducing the concentration of the B component by up to about 20% results in spray cast alloys having reduced deformation at elevated temperatures. More preferably, the B component composition is within about 25% above the solid solubility point 64 to about 10% below the point 64.

Solidification initiates at the liquidus temperature 74. When the alloy reaches the eutectic temperature 66, the dual phase alloy forms. The rich phase forms both within the grains and at the boundaries between grains.

A rapid cooling rate in excess of about 1° C. per second and more preferably between about 10° C. per second and about 100° C. per second is required to maintain the phase as discrete dispersoids with an average particle size of from about 0.1 microns to about 1.0 microns. More preferably, the dispersoid range is from about 0.1 microns to about 0.5 microns.

The application of the process of the invention to alloys which undergo a eutectic phase transformation will be more clearly expressed by the following example.

EXAMPLE 2

Two alloys which undergo a eutectic reaction, copper/chromium and copper/zirconium, were prepared by button casting and by spray casting. For the copper/chromium alloy system, the solid solubility point composition is 0.65% by weight chromium. The effective chromium composition is from about 0.52% by weight chromium to about 0.98% by weight chromium and the preferred chromium composition is from about 0.58% by weight chromium to about 0.81% by weight chromium. For the copper/zirconium system, the solid solubility point composition is 0.15% by weight zirconium.

Copper/0.7% by weight chromium and copper/0.7% by weight zirconium samples were produced by spray casting and by button casting. The samples were work hardened by cold rolling to an 88% reduction and then heated for one hour. The hardness of both conventionally cast alloys decreased dramatically at 500° C. while the spray cast alloy did not soften to the same extent.

TABLE 3

| Alloy | Casting Method | Hardness ($H_v$) After 1 Hour R.T. | 300° | 400° | 500° |
|---|---|---|---|---|---|
| Cu/Cr | Spray | 130 | 132 | 183 | 180 |
| Cu/Cr | Button | 134 | 134 | 182 | 162 |
| Cu/Zr | Spray | 150 | 162 | 161 | 132 |
| Cu/Zr | Button | 150 | 156 | 161 | 110 |

The inhibition to recrystallization resulting in improved resistance to softening is most pronounced at 500° C. This temperature range is significant in the manufacture of leadframes for electronic packages. Many of the sealing glasses used in package assembly have fusing temperatures of about 450° C.

To determine compositional limits, spray cast copper/chromium alloys having increasing concentrations of chromium were prepared. The maximum softening resistance was at 0.7% chromium which is 7.7% above the chromium concentration for the solid solubility point 64 for copper chromium alloys. The softening resistance was reduced at both 0.3% by weight chromium, a chromium reduction of 54% from the solid solubility point and for 1.1% by weight chromium, a concentration containing 69% more chromium than at the solid solubility point 64. Table 4 presents the hardness as a function of chromium concentration.

TABLE 4

| Weight % Chromium | Hardness ($H_v$) After 1 Hour R.T. | 500° |
|---|---|---|
| 0.3 | 121 | 117 |
| 0.5 | 134 | 125 |
| 0.7 | 140 | 166 |
| 1.1 | 134 | 107 |

The copper/0.7% zirconium sample had a zirconium concentration 366% greater than the solid solubility limit of 0.15% Zr by weight. While an improvement in softening resistance is noted, it is believed maintaining the zirconium concentration within the limits of the invention would yield superior results. The zirconium concentration is preferably from about 0.12% by weight to about 0.23% by weight and more preferably from about 0.14% by weight to about 0.19% by weight.

The examples illustrate the formation of copper base alloys which contain a second phase dispersoid uniformly dispersed through an alloy matrix. The size and distribution of the dispersoid is controlled by maintaining a controlled cooling rate through the use of spray casting. The examples are illustrative and the invention is not intended to be limited to the copper alloys disclosed above. Any copper base alloy system which includes a precipitate second phase may be processed according to one of the embodiments of the invention.

EXAMPLE 3

The following alloys could also be spray cast according to the method of the invention. The cast alloys would have a second phase precipitate of the desired size distribution and resist recrystallization.

| Alloy | Type of Reaction | Solid Solubility Concentration | B Component Concentration |
|---|---|---|---|
| Cu—B | Eutectic | 0.53 | .42–.80 |
| Cu—V | Peritectic | 0.32 | .27–.48 |
| Cu—Ti | Eutectic | 4.7 | 3.8–7.1 |
| Cu—Mg | Eutectic | 3.3 | 2.6–5.0 |

Further, ternary alloys containing any of the above binary compositions plus an additive selected from the group consisting of chromium, zirconium, niobium, vanadium, titanium, magnesium, iron, phosphorus, silicon, aluminum, antimony, bismuth, boron, tin, and Misch Metal would also benefit from the process of the invention.

In connection with copper-iron-zirconium alloys, by using the spray casting method as described above, the iron content of such alloys may be up to about 5.0% by weight without the dispersoids increasing significantly in size and becoming coarse and still maintain improved properties in relation to alloys cast by the conventional process. Table 5 below sets forth the properties for various percentages of iron and zirconium.

In the Table, yield strength (YS) and ultimate tensile strength (UTS) are given in KSI.

TABLE 5

| Alloy | Composition | % IACS | YS | UTS | % E |
|---|---|---|---|---|---|
| 1 | Cu-2.5% Fe-0.23% ZR | 63 | 74 | 75 | 3 |
| 2 | Cu-2.8% Fe-0.15% Zr | 61 | 78 | 79 | 2.5 |
| 3 | Cu-3.1% Fe-0.15% Zr | 63 | 79 | 80 | 2 |
| 4 | Cu-4.7% Fe-0.14% Zr | 61 | 75 | 79 | 2 |
| 5 | Cu-2.8% Fe-0.17% Zr | 59 | 60 | 61 | 2.5 |

Alloys 1–4 of Table 5 were spray cast as under the following conditions:

a. Melt temperature = 1200° C.
b. Gas pressure = 100 psi
c. Collector surface = copper foil over a porous ceramic (PYROTEC), the initial temperature of the collector surface being at room temperature.
d. Distance between atomizer and collector = 17 inches.

The spray cast deposits were milled on both sides to provide samples of 0.5 inch thickness. The samples were cold rolled to 0.1 inch and were heat treated at 1000° C. for 10 seconds followed by cold rolling to 0.02 inch. The samples were then heat treated at 500° C. for two hours followed by cold rolling to 0.014 inch after which they were tested for properties.

Alloy 5 was cast conventionally in a Durville book mold. Alloy 5 was hot rolled to 0.5 inch at 900° C. using a five-pass schedule, after which it was cold rolled and treated in a manner similar to the spray cast alloys.

From Table 5 it can be seen that the properties for spray cast Samples 1–4 containing iron up to about 5.0% were substantially better than those for a conventionally-cast alloy of a similar composition. The zirconium is present in the alloy to reduce the porosity of the spray cast deposit. The zirconium may be present in the amount of from about 0.05 up to an amount which would tend to reduce the properties. Preferably, the upper limit is about 0.5 percent.

The patents and publications set forth in the application are intended to be incorporated by reference.

While the invention has been described above with reference to specific embodiments thereof, it is apparent that any changes, modifications, and variations can be made without departing from the inventive concept disclosed herein. Accordingly, it is intended to embrace all such changes, modifications and variations that fall within the spirit and broad scope of the appended claims. All patent applications, patents and other publications cited herein are incorporated by reference in their entirety.

What is claimed is:

1. A spray cast copper base alloy having improved resistance to thermal softening, comprising:

a coalesced multitude of droplets, each said droplet consisting essentially of:

copper; and iron and zirconium, said iron being present as a uniformly dispersed second phase of dispersoids, said dispersoids having a mean particle size of from about 0.1 micron to about 1.0 micron, said iron being present in the amount of from about 2.0 to about 5.0% by weight.

2. The spray cast alloy of claim 1 wherein zirconium is present in the amount of from about 0.05% to about 0.50% by weight.

* * * * *